US006101893A

United States Patent [19]

Wergen

[11] Patent Number: 6,101,893

[45] Date of Patent: Aug. 15, 2000

[54] MULTI-AXIS HAND CONTROLLER

[76] Inventor: Gerhard Wergen, Parkstrasse 1, D-90513 Zirndorf, Germany

[21] Appl. No.: 09/230,373

[22] PCT Filed: Jul. 15, 1997

[86] PCT No.: PCT/EP97/03814

§ 371 Date: May 17, 1999

§ 102(e) Date: May 17, 1999

[87] PCT Pub. No.: WO98/04998

PCT Pub. Date: Feb. 5, 1998

[30] Foreign Application Priority Data

Jul. 26, 1996 [DE] Germany ..... 196 30 075

[51] Int. Cl.[7] ..... G05G 9/047

[52] U.S. Cl. ..... 74/471 XY; 200/6 A; 345/161

[58] Field of Search ..... 74/471 XY; 200/6 A; 345/161

[56] References Cited

U.S. PATENT DOCUMENTS

| | | | |
|---|---|---|---|
| 3,771,037 | 11/1973 | Bailey, Jr. | 318/580 |
| 3,835,702 | 9/1974 | Van Patten | 73/133 R |
| 4,348,142 | 9/1982 | Figuor | 74/471 XY X |
| 4,348,634 | 9/1982 | David et al. | 74/471 XY X |
| 4,688,444 | 8/1987 | Nordstrom | 74/471 XY X |
| 5,831,596 | 11/1998 | Marshall et al. | 345/161 |

FOREIGN PATENT DOCUMENTS

| | | | |
|---|---|---|---|
| 0565757 | 10/1993 | European Pat. Off. | G05G 9/047 |
| 3240251 | 5/1984 | Germany | B25J 9/00 |

*Primary Examiner*—Allan D. Herrmann
*Attorney, Agent, or Firm*—Wood, Herron & Evans, L.L.P.

[57] ABSTRACT

A multidimensional handle controlled without displacement is used for precisely positioned control and input. The actuating rod is selectively and simultaneously subjected to lateral pressure and to bending by a surrounding fist. The third dimension is controlled without displacement by the thumb, which acts on an additional sensor lever.

21 Claims, 5 Drawing Sheets

MULTI-AXIS HAND CONTROLLER

FIELD OF THE INVENTION

The present invention generally relates to hand controllers having multiple degrees of freedom.

BACKGROUND OF THE INVENTION

A handle known as a three-dimensional or so-called space mouse for complex mechanical control tasks or for computer input that is to be varied spatially is described in greater detail in its basic form in DE 32 40 251 A1. In order to use this handle a spherical actuation element must be taken between the fingertips of one hand and must be twisted about the vertical, horizontal and longitudinal axes as carefully as possible. This procedure is very tiring, however, and therefore subject to error, because considerable torsion forces must be applied by way of the fingertips and the hand must impinge from above and thus cannot be supported.

SUMMARY OF THE INVENTION

The present invention is therefore based on the problem of creating a handle which can be operated more pleasantly and therefore more precisely and can nonetheless be employed flexibly.

In accordance with the present invention, an actuation rod is optionally stressed for a biaxial handle both transversely and flexurally by being gripped by the fist. A lever system articulated to that rod acts on different pressure sensors for the two functional axes. These operate practically without displacement, so that actually no lever excursions appear and therefore the rod linkage can be implemented compactly in tubular form. In one embodiment, an additional sensor lever is operated by the thumb to provide a third degree of freedom.

DETAILED DESCRIPTION OF PREFERRED EMBODIMENTS

Figure 1:
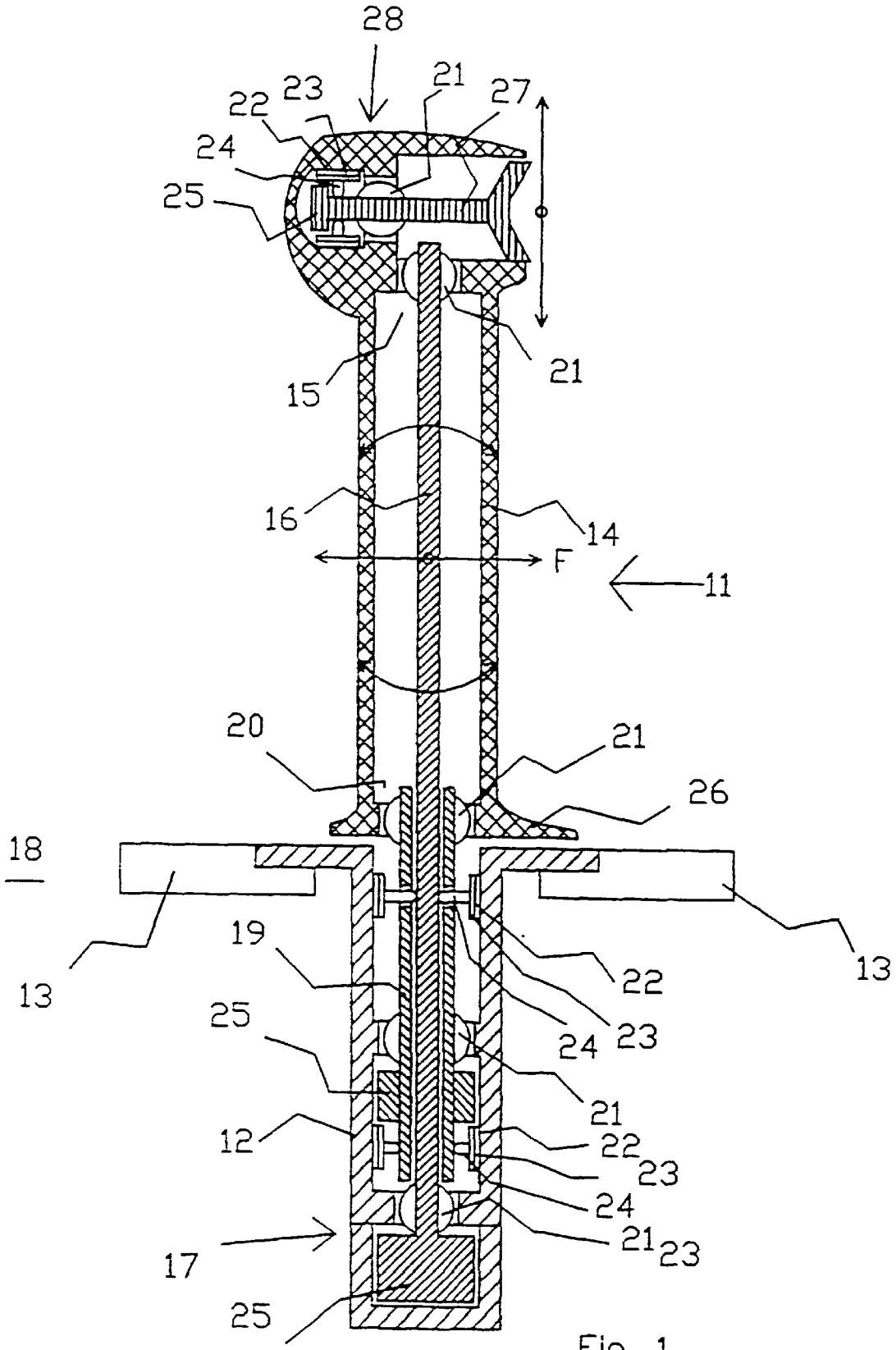
FIG. 1 is a cross-sectional view of an installed handle with sensors located in the base.

Handle 11 illustrated in FIGS. 1–4 can be mounted permanently by means of base 12, possibly in a control console 13. Arranged in front of the respective base 12 is an actuation rod 14 for absorbing and transferring transverse and flexural forces introduced into it manually. This actuation rod 14 is suspended free to pivot at its end 15 remote from the base 12 on a central rod 14 for absorbing and transferring transverse and flexural forces introduced into it manually. This actuation rod 14 is suspended free to pivot at its end 15 remote from the base 12 on a central rod 16, which in turn is mounted free to pivot on the end 17 of the base 12 which is remote from the actuation rod 14. The console installation plane 18 between base 12 and actuation rod 14 is bridged by a coupling rod 19, which in turn is mounted at the end 20 of the actuation rod 14 facing the plane 20 on the one hand, and is articulated to the base 12 on the other. All joints 21 are designed to be as freely moving as possible, possibly as convex spherical caps in hollow spherical shells. Since all joints 21 are pivoted about mutually parallel axes (oriented transverse to the drawing plane) in case of the introduction of force into the actuation rod 14, they can also be executed as rolling contact joints 21.

The central rod 16 and the coupling rod 19 are each supported against their two pivoting directions free of play against pressure sensors 22 responding almost without displacement. Pressure sensors 22 are subjected to stress over a wide area via pressure plates 23 which in turn are subjected to force in their central areas according to the transverse and flexural forces currently being introduced manually from bulger or transfer ball 24 into the actuation rod 14. Because of the always identical direction of force introduction, this results in a high constancy of the sensor characteristics. The joints 21 act as lever rotation points, with regard to which the levers in the form of the central rod 16 and the coupling rod 19 are counterbalanced by counterweights 25 to an indifferent equilibrium. This brings about a high response sensitivity of the sensors 22 to manual force introduction into the handle 11 and an insensitivity of the sensor output signal to shocks acting from the outside on the handle 11 and from changes in the position of the handle 11 in space.

Since, therefore, the rods seated so as to be pivotable with respect to one another and the base 12 and dimensioned so as to be deflection resistant are actually not markedly pivoted at all upon actuation of the rod 14, due to the rigid sensor supports, the rods need not be arranged one alongside the other; rather, they can run coaxially one inside the other in tubular form with a slight play and through the likewise tubular base 12. Then a tubular coupling rod 19 inside the base 12 and even projecting beyond its installation plane 12 into a likewise tubular actuation rod at the bottom surrounds the central rod 16. That permits an ergonomic and compact construction of the joystick 11 with a protected sensor arrangement inside the outer tube, as shown in FIGS. 1–4.

Regarding the force flow via the joints 21 to the sensor 22, the coupling rod 19 acts as a two-armed rod and the central rod 16 as a one-armed one. The sensors 22 of the coupling rod 19 lie between its non-seated end and the structural part on which the lever joint 21 of the coupling rod 19 is mounted (in FIG. 1, this is the base 12). The sensors 22 of the central rod 16 are arranged between the latter and the same construction part; in case of a tubular structure of the handle 11 according to FIG. 1with an arrangement of all sensors 22 inside the base 12, however, elongated bulger 24 must be provided, which penetrate radially through wall holes in the tubular coupling rod 19 in order to be able to be supported directly against the central rod 16 running therein, unless the more difficult-to-assemble deviation according to FIG. 2 is undertaken.

Figure 2:
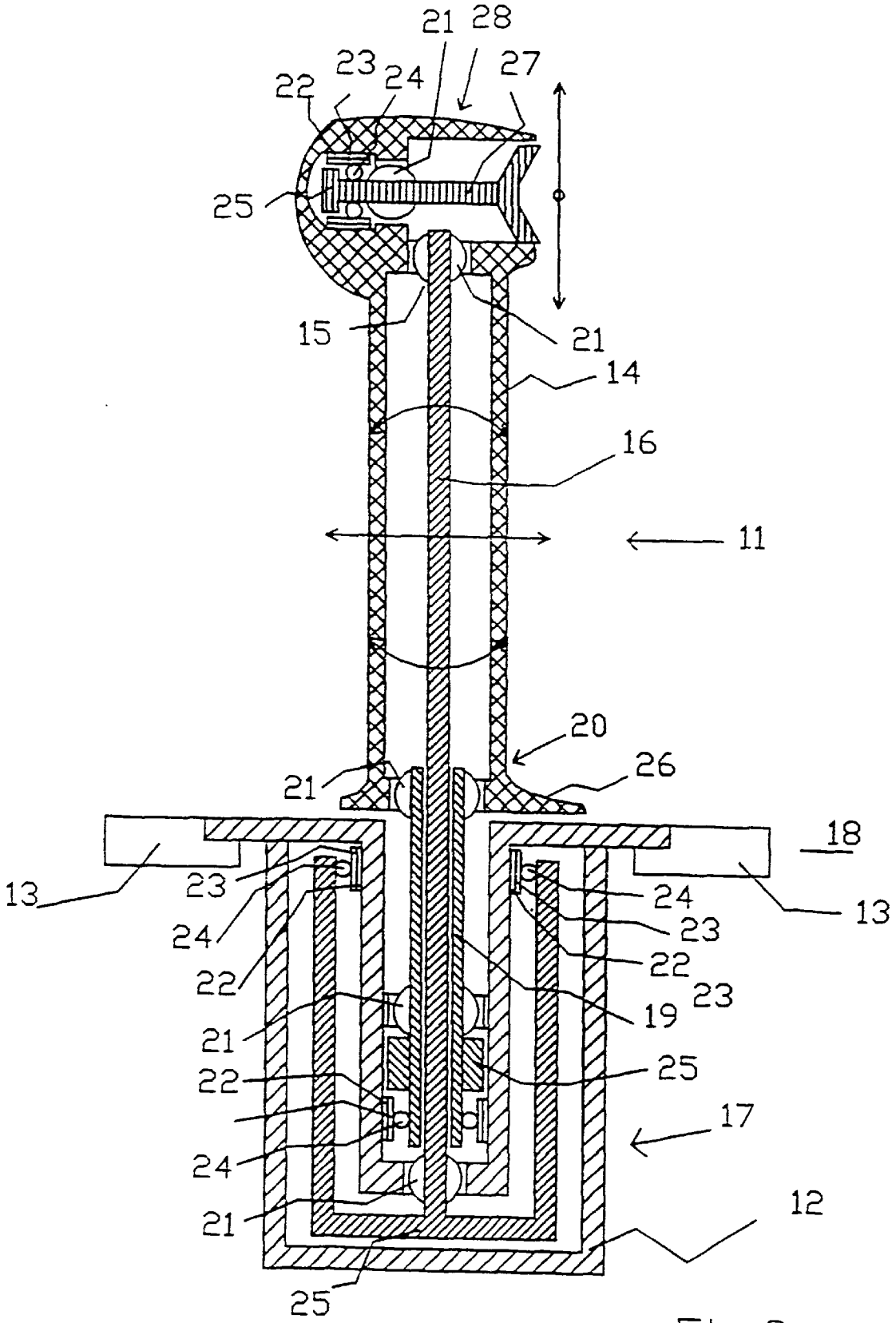
FIG. 2 is a cross-sectional view of a handle similar to that in FIG. 1, but with load sensors placed on the central rod sensors by way of a two-armed lever.
Figure 3:
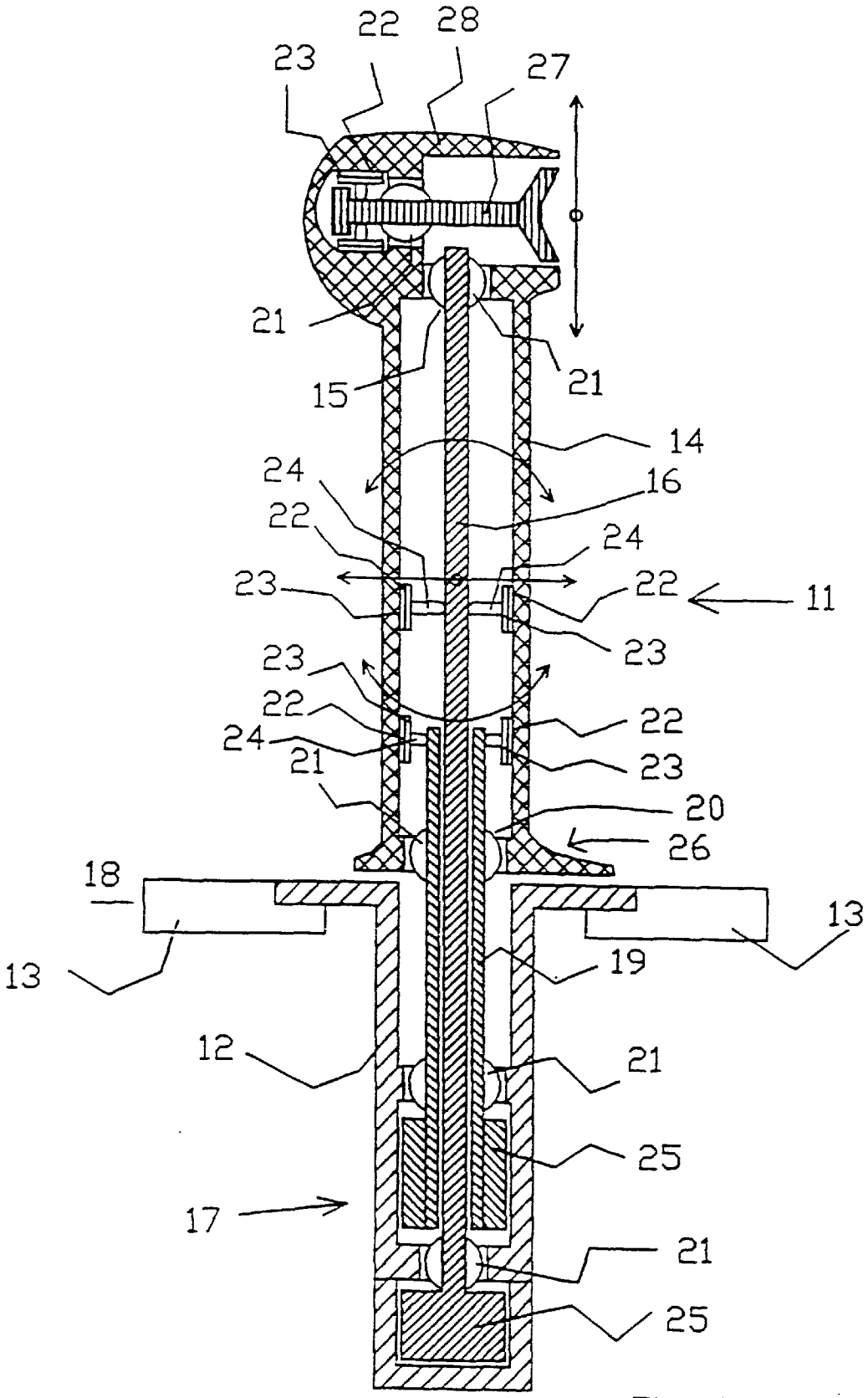
FIG. 3 is a cross-sectional view of a handle similar to that in FIG. 1, but now with sensors in the hollow actuation rod.
Figure 4:
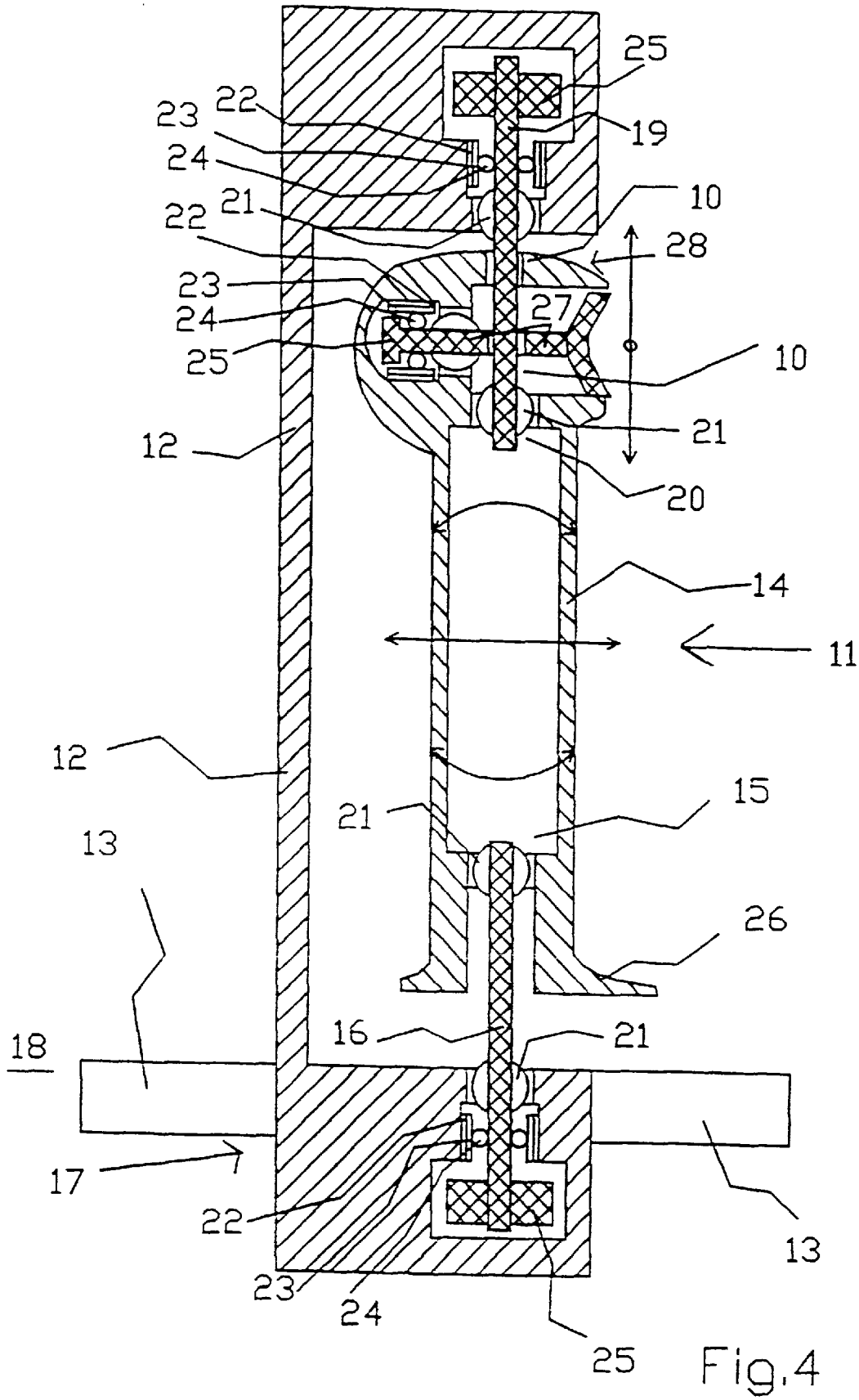
FIG. 4 is a cross-sectional view of a handle similar to that in FIG. 1, only that the other sensor is arranged in mirror-image manner.

While the sensor pair 22, located in the base 12 immediately underneath the installation plane 18 for the absorption of force from the central rod 16, requires an additional seal perhaps in the form of a corrugated sleeve at the transition from the hollow actuation rod 14 to the base 12 as protection against environmental influences, this is not necessary for the embodiments shown in FIG. 2, the mirroring according to FIG. 4, or in the case of the displacement of all sensors 22 out of the base 12 into the hollow coupling rod 19 according to FIG. 3, because then the sensors 22 are located closed off behind bearing joints 21.

In FIG. 4, the base 12 is pulled up so high that the rod 19 lies in the linear extension of the rod 16. Deviating from the other arrangements, the rod 19 leads at the openings 10 through the pivot lever 27 and the upper part of the rod 14.

Not taken into account in the schematic drawing is the fact that it is practical for the outer surface of the actuation rod to be shaped in the manner of a grip for the surrounding fingers of a fist. Since the rods are each rigidly seated in the longitudinal direction at their joints 21, and since the sensors 22 can in any case only be excited by radially transmitted transverse forces (but not by possible longitudinal displacements of the rods), a fatigue-free operation of the handle 11 will result since a fist gripping the actuation rod 14 can be laid down during operation with its full weight on the installation plane 18, or on a support collar 26 at the lower end 20 of the actuation rod 14 while the manual introduction of force is taking place. For the same reason, a twisting of the actuation rod about its longitudinal axis in the case of ball joints would not lead to a falsification of the sensor signals.

For one functional axis, the introduction of force consists in the input of a transverse force parallel to the installation plane 18, which leads to an excursion of central rod 16 and coupling rod 19 in the same direction; this can be evaluated by differential evaluation of the sensor signal pairs for control tasks. The second functional axis is served by the surrounding fist by inputting a tilting or pivoting force into the actuation rod 14, which leads to an opposing excursion of the central and coupling rods 16, 19 and can likewise be detected by the corresponding opposite behavior of the sensor signals. A simultaneous (superimposed) displacement and pivoting stress on the actuation rod 14 in the same actuation plane (namely, across the pivoting axes of the joints 21) thus supplies two-dimensional control information.

Sensitivities (slopes of the sensor signal characteristic curves) which are equal or which differ in a defined manner can be adjusted as desired by way of the effective lever lengths, i.e., the sensor arrangements along the rods.

If sensor pairs are likewise provided transverse to the plane of the drawing and possibly a Cardan joint also permits a stress on the rods in this pivoting direction, then two additional degrees of freedom are created. For the third dimension, however, it is preferable that on the upper end 15 of the actuation rod 14 an additional, likewise counterbalanced two-armed pivot lever 27 with sensors 22 be arranged in a surrounding housing 28. The lever 27 can be operated by means of the thumb gripping the actuation rod 14 during the transverse and tilting stressing of the actuation rod 14, that is, likewise placed under vertical stress (and perhaps even transverse to this direction), without displacement and free of play, at its freely accessible lever arm.

Figure 5:
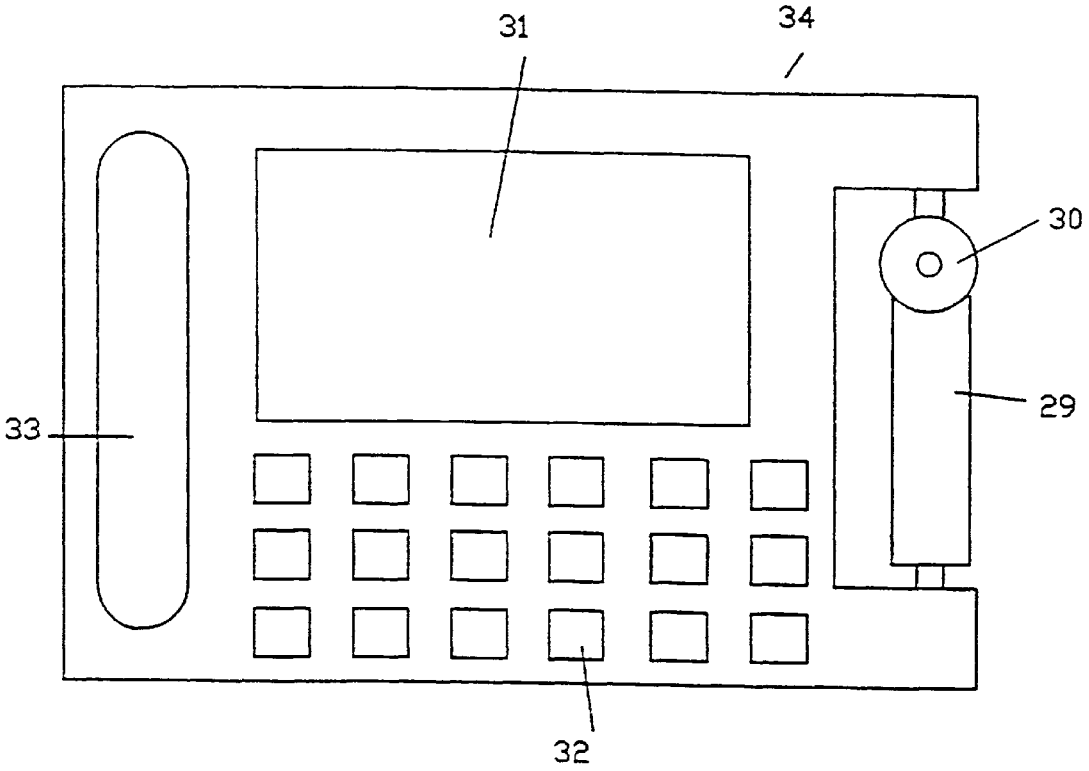
FIG. 5 is a plan view of the arrangement of the multidimensional handle in an operating and display device.

In FIG. 5, the installation of the handle is in a portable operating and display device 34 that consists of the display 31, the keyboard 32 and a fixed holding grip 33 and the four-axis operating lever 29 for the hand and 2-axis thumb-actuation element and permits a positionally correct 6-D input.

Thus an input device for control tasks of all types in, for instance, machine guidance or for computer inputs is created which can be set up compactly and handled precisely without fatigue.

What is claimed is:

1. A multidimensional handle comprising:

a central rod having first and second ends;

a stationary base, said first end of said central rod being pivotally fastened to said stationary base;

an actuation rod having first and second ends, said first end of said actuation rod being pivotally fastened to said second end of said central rod;

a coupling rod operatively associated with said central rod and said actuation rod; and a plurality of sensors adapted to detect input forces transmitted from said actuation rod to at least one of said central rod and said coupling rod.

2. The handle according to claim 1, wherein said plurality of sensors is adapted to sense the input forces transmitted through the actuation rod.

3. The handle according to claim 2, wherein said central rod extends into said coupling rod and said actuation rod.

4. The handle according to claim 1, wherein said coupling rod acts as a two-armed rod and said central rod acts as a one-armed rod with respect to the input forces transmitted from the actuation rod to the sensors.

5. The handle according to claim 1, further comprising at least one pair of rolling-element joints operatively associated with said actuation rod and said coupling rod, said rolling-element joints adapted to pivot about at least one rotational axis.

6. The handle according to claim 1, wherein the central rod and the coupling rod are counterbalanced by counterweights.

7. The handle according to claim 1, further comprising a support collar operatively connected to the actuation rod to provide support for a hand gripping the handle.

8. The handle according to claim 1, further comprising a pressure plate and a transfer ball operatively associated with each of said sensors.

9. The handle according to claim 1, wherein at least one sensor is operatively associated with the central rod and the coupling rod and at least one sensor is operatively associated with the base and the coupling rod.

10. The handle according to claim 1, further comprising a sensor pivot lever operatively associated with and disposed transversely to the actuation rod.

11. A hand controller capable of moving about multiple degrees of freedom comprising:

a base member having an opening and sidewalls extending therefrom;

an actuation rod having first and second ends, said actuation rod sized for gripping by a hand so that said actuation rod can be moved about a plurality of degrees of freedom relative to said base member;

a central rod having first and second portions operatively connected respectively to said base member and said first end of said actuation rod, said central rod movable in response to movement by said actuation rod;

a coupling rod associated with said central rod and operatively connected to said base member and said actuation rod, said coupling rod movable in response to movement by said actuation rod and said central rod; and first and second sensor pairs mounted to said base member sidewalls and adapted to detect movement of said central rod and said coupling rod in response to movement of the actuation rod about a plurality of degrees of freedom.

12. The hand controller of claim 11, wherein said first sensor pair engages said central rod to detect movement in said central rod, said second sensor pair engages said coupling rod to detect movement in said coupling rod.

13. The hand controller of claim 11, further comprising:

a plurality of pivotal joints connecting said actuation rod to said central rod and said base member and connecting said coupling rod to said base member.

14. The hand controller of claim 11, wherein said central rod further includes a counterweight for counterbalancing movements of said actuation rod.

15. The hand controller of claim 11, wherein said central rod includes a pair of arms extending from said first portion of said central rod and positioned along the exterior of said sidewalls of said base member, said first sensor pair engages said arms and said exterior of said sidewalls to detect movement in said central rod, said second sensor pair engages said coupling rod to detect movement in said coupling rod.

16. The hand controller of claim 11, further comprising:

a movable lever disposed at said first end of said actuation rod, said lever being movable by the thumb of a hand gripping said actuation rod; and a sensor pair associated with said movable lever, said sensor pair adapted to detect movement of said lever.

17. The hand controller of claim 16, wherein said movable lever includes a counterweight for counterbalancing movements of said lever.

18. A hand controller capable of moving about multiple degrees of freedom comprising:

a base member having first and second ends;

an actuation rod having first and second ends, said actuation rod sized for gripping by a hand so that said actuation rod can be moved about a plurality of degrees of freedom relative to said base;

a first central rod operatively connected to and extending between first end of said base member and said first end of said actuation rod, said first central rod movable in response to movement by said actuation rod;

a second central rod operatively connected to and extending between second end of said base member and said second end of said actuation rod, said second central rod movable in response to movement by said actuation rod;

first and second sensor pairs mounted respectively to said first and second ends of said base member to engage said respective first and second ends of said actuation rod, said first and second sensors adapted to detect movement of said first and second central rods in response to movement of said actuation rod about a plurality of degrees of freedom.

19. The hand controller of claim 18, further comprising:

a movable lever disposed at said first end of said actuation rod, said lever being movable by the thumb of a hand gripping said actuation rod; and a sensor pair associated with said movable lever, said sensor pair adapted to detect movement of said lever.

20. The hand controller of claim 19, wherein said movable lever includes a counterweight for counterbalancing movements of said lever.

21. The hand controller of claim 18, further comprising:

a plurality of pivotal joints connecting said actuation rod to said first and second central rods and to said first and second ends of said base member.

* * * * *